United States Patent [19]

Chang

[11] Patent Number: 4,868,552

[45] Date of Patent: Sep. 19, 1989

[54] APPARATUS AND METHOD FOR MONOCHROME/MULTICOLOR DISPLAY OF SUPERIMPOSED IMAGES

[75] Inventor: Tsong-Ju P. Chang, Dix Hills, N.Y.

[73] Assignee: Rohde & Schwartz-Polarad, Lake Success, N.Y.

[21] Appl. No.: 899,939

[22] Filed: Aug. 25, 1986

[51] Int. Cl.[4] ..... G09G 1/16

[52] U.S. Cl. ..... 340/721; 340/734; 340/703; 324/77 R; 324/121 R

[58] Field of Search ..... 340/701, 706, 703, 709, 340/721, 734, 747; 324/121 R, 77 A, 77 B, 77 C, 77 R; 315/377; 364/487; 73/866.3

[56] References Cited

U.S. PATENT DOCUMENTS

| | | | |
|---|---|---|---|
| 4,295,135 | 10/1981 | Sukonick | 340/703 |
| 4,400,780 | 8/1983 | Nagao et al. | 340/734 |
| 4,439,760 | 3/1984 | Fleming | 340/703 |
| 4,484,187 | 11/1984 | Brown et al. | 340/703 |
| 4,509,043 | 4/1985 | Mossaides | 340/703 |
| 4,628,254 | 12/1986 | Bristol | 324/77 R |
| 4,641,348 | 2/1987 | Neuder et al. | 364/487 |

*Primary Examiner*—David K. Moore
*Assistant Examiner*—Jeffery A. Brier
*Attorney, Agent, or Firm*—Darby & Darby

[57] ABSTRACT

A multicolor display system includes a graphics display controller for selectively generating bit patterns of pixel data for a plurality of images for display; a plurality of memories for storing the bit patterns for each image respectively, and for establishing a plurality of individual memory planes each associated with particular ones of the images; a color look-up table coupled to the memories for receiving the bit patterns therefrom and selectively establishing a color priority hierarchy among the associated image planes, for providing for display only the pixel data bits associated with the highest priority image plane at display locations or pixel points where the images of two or more image planes intersect; and D/A converters for converting the pixel data bits for each memory plane from the look-up table to analog signals for connection to a display device.

18 Claims, 7 Drawing Sheets

| | IMAGE PLANE | | | | | | VIDEO DISPLAY TERMINAL | | | |
|---|---|---|---|---|---|---|---|---|---|---|
| | 1 | 2 | 3 | 4 | ---------- | n | R | G | B | COLOR |
| A | 1 | 0 | 0 | 0 | ---------- | 0 | 0 | 0 | 1 | BLUE |
| B | 0 | 1 | 0 | 0 | ---------- | 0 | 0 | 1 | 0 | GREEN |
| C | 0 | 0 | 1 | 0 | ---------- | 0 | 1 | 0 | 0 | RED |
| D | 0 | 0 | 0 | 1 | ---------- | 0 | 1 | 1 | 0 | YELLOW |
| E | 0 | 0 | 0 | 0 | ---------- | 1 | 1 | 1 | 1 | WHITE |

VARIABLE GRID

PIXEL DATA FROM PLANE LOOK-UP TABLE

| IMAGE | 1 | 2 | 3 | GREEN | RED | BLUE | COLOR |
|---|---|---|---|---|---|---|---|
| BACKGROUND | OFF | OFF | OFF | OFF | OFF | ON | BLUE |
| CURVE | ON | X | X | ON | ON | OFF | YELLOW |
| CURSOR LINES | OFF | ON | X | OFF | ON | OFF | RED |
| GRID | OFF | OFF | ON | ON | OFF | OFF | GREEN |

NOTE: X DENOTES DON'T CARE

FIG. 10

| TABLE LOCATION | PLANE NUMBER | | | DATA BITS GREEN | | | RED | | | BLUE | |
|---|---|---|---|---|---|---|---|---|---|---|---|
| | 1 | 2 | 3 | 1 | 2 | 3 | 4 | 5 | 6 | 7 | 8 |
| 1 | 0 | 0 | 0 | 0 | 0 | 0 | 0 | 0 | 0 | 1 | 1 |
| 2 | 1 | 0 | 0 | 1 | 1 | 1 | 1 | 1 | 1 | 0 | 0 |
| 3 | 0 | 1 | 0 | 0 | 0 | 0 | 1 | 1 | 1 | 0 | 0 |
| 4 | 1 | 1 | 0 | 1 | 1 | 1 | 1 | 1 | 1 | 0 | 0 |
| 5 | 0 | 0 | 0 | 1 | 1 | 1 | 0 | 0 | 0 | 0 | 0 |
| 6 | 1 | 0 | 1 | 1 | 1 | 1 | 1 | 1 | 1 | 0 | 0 |
| 7 | 0 | 1 | 1 | 0 | 0 | 0 | 1 | 1 | 1 | 0 | 0 |
| 8 | 1 | 1 | 1 | 1 | 1 | 1 | 1 | 1 | 1 | 0 | 0 |

FIG. 11

APPARATUS AND METHOD FOR MONOCHROME/MULTICOLOR DISPLAY OF SUPERIMPOSED IMAGES

FIELD OF THE INVENTION

The present invention relates generally to display systems, and more particularly to a method and apparatus for providing the superimposed monochrome/multicolor display of alphanumeric and graphical images free of interference at common pixel or display points between these images.

BACKGROUND OF THE INVENTION

Typical color display systems include a display device such as a cathode ray tube having three-color inputs, for example, for providing the primary colors of blue, red, and green, respectively. If electrical signals representing three different images, for example, are connected respectively to the red, green, and blue input terminals of the display device, wherever the images overlap on the display, the associated color images will "mix". If for example a green colored image overlaps with a red colored image at a given location or locations on a display, a yellow coloration will result wherever such overlap occurs.

In Krause et al. U.S. Pat. No. 4,574,277, a computer-controlled video display system is disclosed which includes three video memory planes, each associated with an individual primary color, and each of which may be selectively disabled for obtaining special effects. One special effect is that of providing limited animation by displaying one page while generating a new page in a non-display page. Krause et al. disables a currently displayed plane while enabling a new plane, thereby providing instantaneous page modification for simulating various animations. Three banks of memory are included for producing either eight colors or eight levels of grey-scale display. A RAM memory is used for storing bit-map videographics from a computer implemented for driving the video display. As previously mentioned, selective disablement of any of the eight video planes is used to obtain a desired effect.

Mossaides U.S. Pat No. 4,509,043 discloses a system for superimposing either monochrome or multicolor images on a display to form a composite image. The various images are prioritized via operator selection, and the prioritized data is stored in a memory. An arithmetic logic unit is used to control the brightness of each image in accordance with its priority, for making the highest priority image have the greatest brightness at points of intersection of the various images.

In Brown et al. U.S. Pat. No. 4,484,187, interactive color addressing is used to provide a video display of overlying images. Two memories are used to store pixel data relating to the two images, which data is then multiplexed and provided to a color-map memory. The color-map memory is organized to provide image priority. Portions of each image are provided to the various color guns in accordance with the priorities established in order to provide multicolor images in an overlying manner on the display.

Raman U.S. Pat. No. 4,420,770 teaches a system for generating video background information. Up to sixteen images are stored in a memory. A priority encoder is included to prioritize the pixel information of each image at a given pixel location to control the area and type of background that are to appear in the output video.

U.S. Pat. No. 4,554,538 teaches a raster scan display system for overlapping images in a multicolor display system, wherein non-interfering erasure and relocation of pixels for one image relative to another is provided by a method for incrementing or decrementing, by one count, the address of the particular pixel. In this manner, interference is substantially eliminated between the overlapping images.

SUMMARY OF THE INVENTION

An object of the present invention is to provide a simplified method and apparatus for prioritizing the image planes of a multi-image display system.

Another object of the invention is to provide a method and apparatus in a monochrome or color display system for prioritizing the individual image planes of the system for obtaining a desired overlap of the images, while preventing interference or color mixing between images due to the intersection of two or more of the images at given pixel locations on the display.

Yet another object of the invention is to provide for the selection of one type of grid from amongst a plurality of possible grids for presentation on one image plane of the display system.

Another object of the invention is to provide double cursors in the horizontal and vertical planes of a display system for facilitating the measurement of various parameters of images being displayed on the display system.

Another object of the invention is to provide in a video system for presenting multiple images, at least two of which are of different colors, color selectivity of the images with elimination of color mixing or interference at pixel locations on a display where the images intersect or overlap, while including selection of a particular type of measurement grid from amongst a plurality of different ones of such grids, and the display of selectively positionable double cursors for measuring various parameters of the images being displayed.

With these objects in mind, the present invention includes means for prioritizing via the pixel information for each image plane a priority hierarchy of image planes, whereby for example the image data for each one of three image planes is connected to a selected one of the red, green, and blue input terminals of a color video display, for only displaying the pixel data for the highest priority image plane at points of intersection of two or more of the images on the display, thereby eliminating undesirable color mixing and/or interference between the images. Also, means are provided for selecting on one image plane image data for a desired measurement grid either underlying or overlying the images being presented in the other image planes, depending upon the relative priority assigned to each one of the image planes, including the image plane of the grid. Lastly, a third means is included for providing selectively movable dual cursors in the vertical and horizontal plane for facilitating various measurements to be taken from the images being displayed. In a monochrome or multicolor display system, the invention provides for selection of the order of superposition of multiple images while substantially eliminating interference between the images.

BRIEF DESCRIPTION OF THE DRAWINGS

The various embodiments of the present invention are described with relation to the below-listed drawings, in which similar items are indicated by the same reference number:

FIGS. 10 and 11 show truth tables associated with the operation of the embodiment of the invention shown in FIG. 9.

DESCRIPTION OF THE PREFERRED EMBODIMENTS OF THE INVENTION

Figure 1:
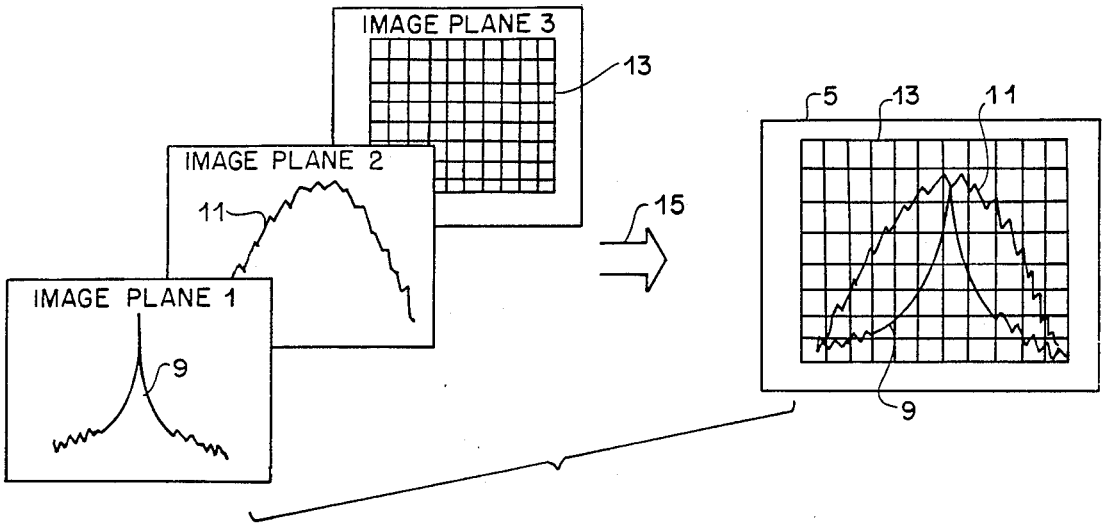
PRIOR ART FIG. 1
FIG. 1 is a pictorial presentation showing the display of three major images, namely two frequency spectrums, and a measurement grid, on three image planes, respectively, in this example.

With reference to FIG. 1, information such as frequency spectrums, alphanumeric data, and/or graphical information can be selectively presented in various image planes of a display system, such as a video display system including a cathode ray tube or a similar output display device 5. Assume that in a first image plane 1 and a second image plane 2, image data are used for producing frequency spectrums 9 and 11, as shown. Also, further assume that in a third image plane 3 imaging data is used for providing a measurement grid 13 is as shown. The image data for the three image planes 1, 2, and 3 are combined, as designated by the arrow 15 to form a composite image on video display 5. Note that there are regions on the display 5 where two or more of the images 7, 9, and 11 overlap. If each one of the image planes 1, 2, and 3 is individually connected to a different color input terminal of a standard RGB color display system, typically color mixing will occur wherever two or more of the images 9, 11, and 13 overlap. Also, in a monochrome system, as well as in a color system, it may be desirable to not permit any mixing of the image data for the images 9, 11, and 13 at points of intersection on the display 5, in order to show a true superposition or overlay of the images 9, 11, and 13.

Figures 2, 3:
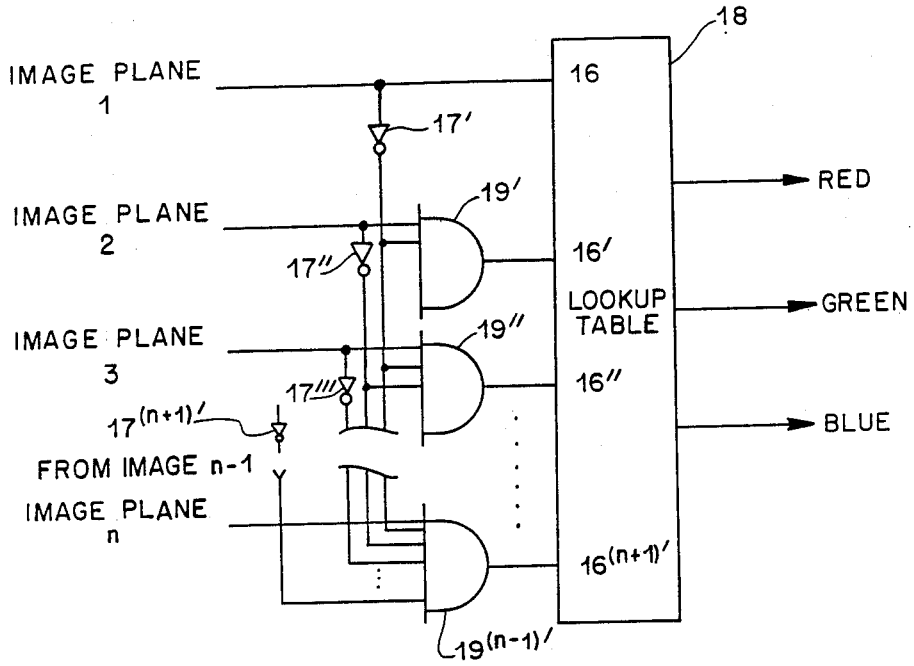
FIG. 2 shows a logic/block diagram for one embodiment of the invention for prioritizing each image plane of a multi-image plane display system.
FIG. 3 shows a truth table for the lookup table of FIG. 2.

By prioritizing the image data for each image plane 1, 2, and 3, and permitting only the highest priority image data at a given pixel point on the display 5 to be presented, undesirable color mixing of the images and other interference therebetween is substantially eliminated. In FIG. 2, the combination of a logic network and lookup table 18 is shown for prioritizing the image data in each one of the three image planes 1, 2, and 3, extendable to n image planes. In this example, the image planes 1, 2, 3 through n are prioritized, and accordingly the associated image data, respectively, is similarly prioritized. As shown, in FIG. 2 image plane 1 is given the highest priority, and in this example the image data of that image plane is directly connected to an input terminal 16 of a lookup table 18. Also, the image or pixel data associated with image plane 1 is connected via an inverter 17' to a first input terminal of each one of a plurality of AND gates 19', 19'', 19''', to $19^{(n-1)'}$. The image data for the second image plane 2 is connected directly to a second input terminal of AND gate 19', and via an inverter 17'', to a second input terminal of AND gate 19''and all subsequent AND gages. The output of AND gate 19' is connected to an input terminal 16' of the lookup table 18. The image data for a third image plane 3 is connected directly to a third input terminal of AND gate 19'', and via an inverter 17''' to an input terminal of another AND gate 19''' (not shown) and all subsequent AND gages. The output of AND gate 19'' is connected to input terminal 16'' of lookup table 18. Image data from the third image plane 3 is connected via an inverter 17''' to an input terminal of an AND gate 19''' (not shown), and the image data from image plane 2 is connected via inverter 17'' to a third input terminal of AND gate 19'', and so forth. In this manner, the prioritizing network of FIG. 2 can be extended to the nth degree for presenting n prioritized image planes (n=1,2,3 . . . ), and the output signals from the various ones of the AND gates 19' through $19^{(n-1)'}$ are applied to input terminals 16', 16'', through $16^{(n-1)'}$ of lookup table 18. Also, for n image planes inverters 17' through $17^{(n-1)'}$ are required, as shown. The arrangement of lookup table 18 is shown in FIG. 3.

With further reference to FIGS. 2 and 3, whenever image data from the highest priority image plane is present, in this example image data from image plane 1, only that image data will be displayed at the associated pixel location on the video display 5 (a CRT for example) and in the chosen color for that image plane (blue in this example). Also in this example, the color for the data of image plane 2 is red, for image plane 3 green, for image plane 4 yellow, and for image plane n white. Other colors could just as readily have been chosen for determining the color of image data for each image plane by rearranging lookup table 18. The inverters 17' through $17^{(n-1)'}$ will cause a digital "0" to appear at one input terminal of each one of the AND gates 19' through $19^{(n-1)'}$ when the respective image plane date is "1". Assuming that a digital "1" indicates the presence of image data, AND gates 19'-$19^{(n-1)'}$ will be disabled by the "0" signal from gating through the image data from their associated image planes 2, 3, 4, . . . n. Accordingly, the image data from image plane 1 has the highest priority. The second highest priority image data is that of image plane 2, in this example, whereby at times when no image data is present at a given pixel location or on the data line for image plane 1, the output from inverter 17' will be positive, enabling AND gate 19 to gate through image data for image plane 2 to the input terminal 16' of the lookup table 18. When image data is present on the data line for image plane 2, the output signal from inverter 17'' will be zero, disabling all of the AND gates 19′ through $19^{(n-1)'}$ thereby preventing the image data from the associated image planes for these latter AND gates to be connected to the lookup table 18. Accordingly, at a given pixel location only the image data from image plane 2 will be displayed in the absence of image data from the highest priority image plane, image plane 1 in this example. Similarly, the third priority image data is that of image plane 3, which in the absence of image data at a given time from image planes 1 and 2 is gated through AND gate 19″ to input terminal 16″ of the lookup table 18 (the output signals from inverters 17′ and 17″ being at digital "1" due to the absence of the image data from image planes 1 and 2. Whenever image data is present from image plane 3, the output of invertor 17″ is at digital zero or ground, disabling all of the following AND gates 19‴ (not shown) through $19^{(n-1)'}$. The fourth highest priority image plane data is for image plane 4 (not shown in FIG. 1), which is gated through AND gate 19⁗ (not shown) in the absence of image data at a given time from image planes 1, 2, and 3. If, for example, only four image planes are required, the lowest priority image plane 4 data line could be kept "high" (digital "1") at all times to provide a yellow background. In a similar manner, the logic circuit can be extended for "n" image planes as shown by the dashed lines, whereby the $n^{th}$ image plane would be associated with an inverter $17^{(n-1)'}$, and an AND gate $19^{(n-1)'}$, where n is the number of image planes, as previously indicated.

In FIG. 3, for purposes of simplicity, a truth table is shown for the arrangement of lookup table 18 for the first four image planes 1, 2, 3 and 4, and the $n^{th}$ image plane, respectively. For example, as shown in row "A", as long as data (a data bit at "1" in this example) is present for a pixel of an image in the image plane 1, that data will be applied to the blue input terminal of the video display 5, regardless of whether image data is present at the same time for the images of the image planes 2 and 3. As shown by row "B", provided that no image data is present from the image plane 1, image data from the image plane 2 will be applied to the green input terminal of the video display 5, regardless of whether image data is present in the third image plane 3. Accordingly, image plane 2 is of second priority to image plane 1. As shown in row "C", provided that no image data is present from image planes 1 and 2, image data from image plane 3 will be gated through to the red input terminal of video display 5. As shown in row D, if data in image plane 4 is present in the absence of data for higher priority image planes, that data will be applied to the red and green input terminals of video display 5 for displaying the data in yellow. In row E, if data in $n^{th}$ image plane is present in the absence of data in a higher priority image plane, the data will be applied to the red, green, and blue input terminals of video display 5 for producing a white display, in this example. In this manner, at a given pixel location on video display 5, only the image data from the highest priority image plane present at the raster time for that pixel location will be displayed, in a preselected color, thereby preventing color mixing and other interference by image data from lower priority image planes. As previously mentioned, lookup table 18 can be rearranged to select desired colors for each of the n image planes.

Figure 4:
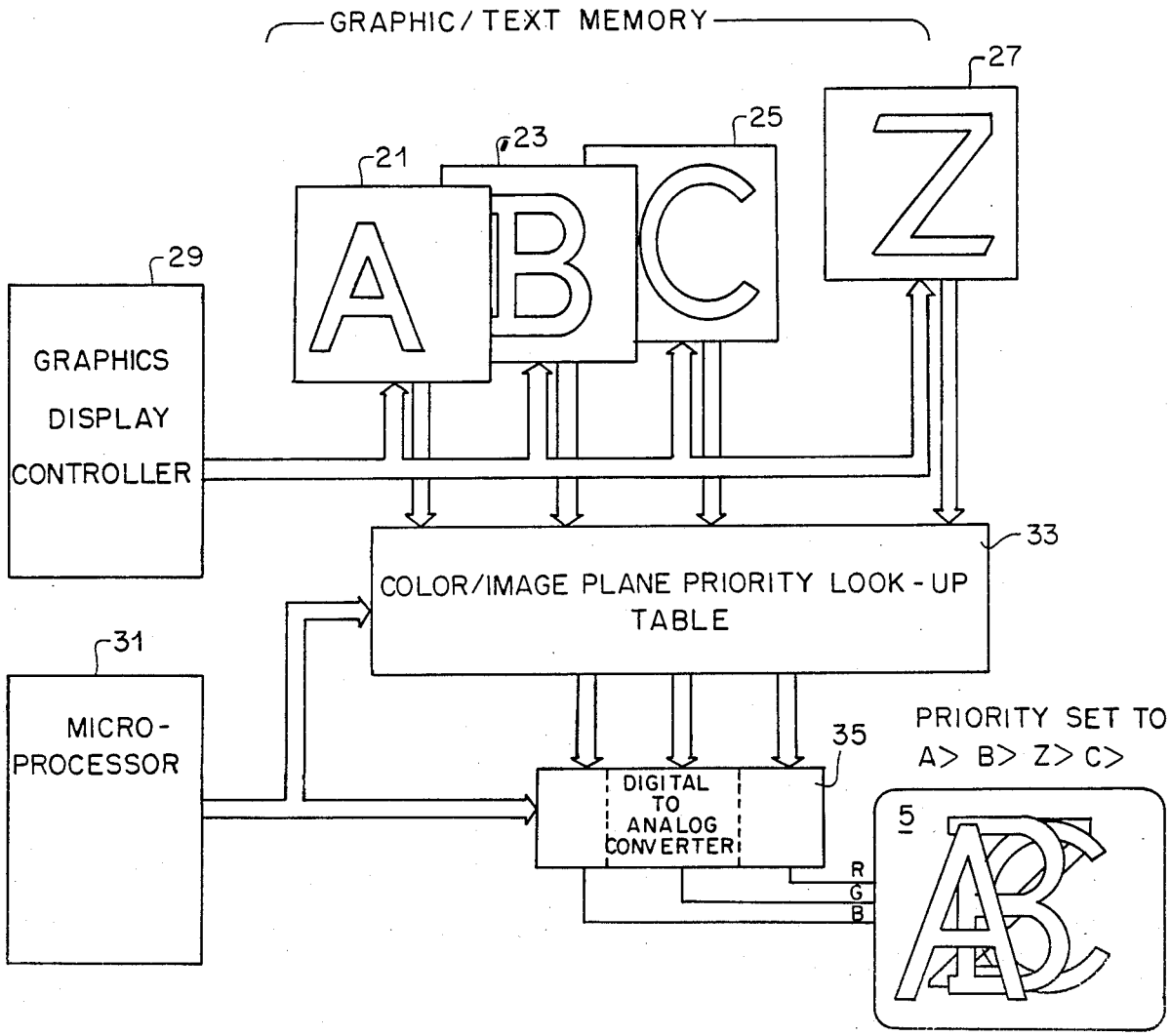
FIG. 4 is a simplified block diagram of one embodiment of the present invention for superimposing the images of three different image planes in a non-interfering manner on a video display, in this example.

In FIG. 4, a simplified block schematic diagram is shown of one embodiment of the invention. As shown, each image plane is relegated to a particular respective individual memory 21, 23, 25, or 27 for the nth memory convenience for convenience. In this simplistic example, image data for the letters A, B, C, and Z are stored in memories 21, 23, 25, and 27, respectively. Other graphical, alphanumeric, and similar image data could otherwise be stored in each one of the memories. A "Graphics Display Controller" 29, such as an NEC PD 7220/GDC, manufactured by NEC Electronics U.S.A. Inc. (hereinafter GDC 29), controls the memories 21, 23, 25, and 27. The GDC 29 scans these memories 21, 23, 25, 27 synchronously, for transferring the image data therefrom for processing, as will be described in further detail later. A microprocessor 31, for example, provides system control for transferring the pixel data from the image planes memories 21, 23, 25, and 27 to address a "Color/Image Plane Priority Look-up Table" 33, for determining the color priority (image plane priority) for each image plane based on the data bit combinations of the image data from the memories 21, 23, 25, and 27. Assume with reference to FIGS. 2 and 3, that the image data in memory 21 is associated with image plane 1, that in memory 23 with image plane 2, in memory 25 with image plane 3, and in memory 27 with image plane 4. Further assume that the color/image plane priority look-up table 33 is the software equivalent of the logic network of FIG. 2. Also assume that the priorities are set up in table 33 as indicated in FIG. 2. The prioritized image data, in this example color prioritized, is connected from the color priority look-up table 33 via a digital-to-analog converter 35 to the red, green, and blue input terminals of the video display 5. Accordingly, in this example, the image data in memories 21, 23, 25 and 27, will be of first, second, third, and fourth priority, respectively. This results in the image data from memory 21 for showing the letter "A" taking priority over any of the other image data, resulting in a blue "A" 37 being displayed as the top-most letter or image data without any interference from the other letters or image data displayed. The second priority image data, in this example the letter "B" is displayed beneath the "A" first priority image, with portions of the "B" being blocked out only by the portions of the first priority image "A". The third priority image from memory 25, the "C" is displayed beneath the "B" and has portions blocked by the images for the first priority "A" and second priority "B". Lastly, the fourth priority image plane, that is the image data from memory 27 representing "Z" has portions blocked out by the overlying higher priority images "A, B, and C". In this example, the "B" will be displayed in red, the "C" in green, and the "Z" displayed in yellow. In summary, for this example, four image planes are presented in true superposition on the video display 5. The first priority image plane 21 provides the blue letter "A", the second priority image plane from data of memory 23 provides the second priority red image "B", the third priority image plane 25 provides the "C" in green, and the fourth priority image plane 27 provides the letter "Z" in yellow, with the higher priority image planes overlying the lower priority image planes. Note that in a monochrome system, the signals to the RGB terminals can be summed for connection to the video input of a monochrome display, for displaying the A,B,C, and Z images in a single color, in non-interfering overlay or superposition, as shown in FIG. 4 on display 5.

Figure 5:
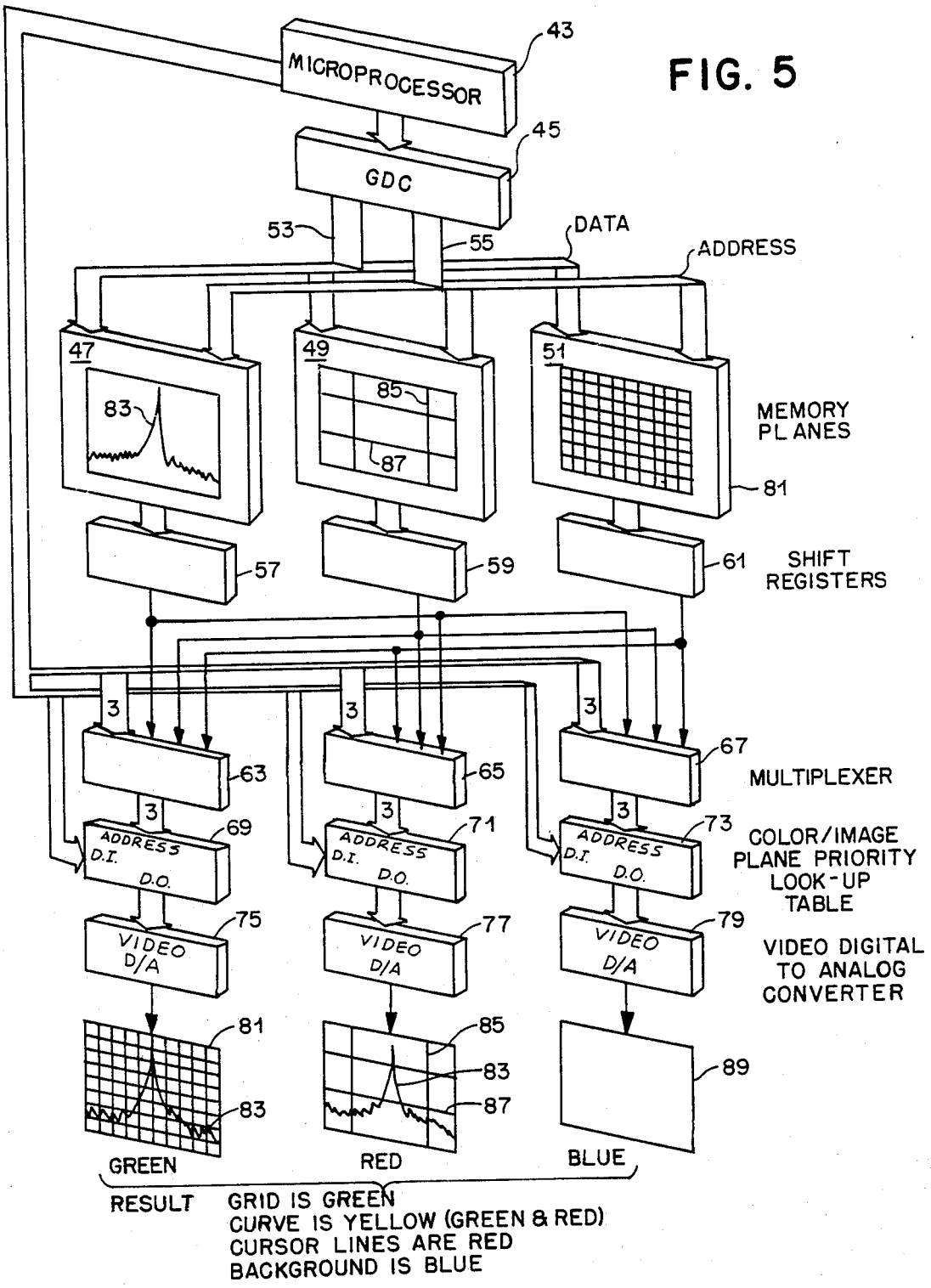
FIG. 5 shows a more detailed pictorialized block schematic diagram of another embodiment of the present invention.

With reference to FIG. 5, a more detailed explanation of various embodiments of the present invention will now be described. The present invention was developed for use in a new multicolor display for a new generation spectrum analyzer, although the invention has much broader usage. A GDC 45, under the control of a microprocessor 43, provides the "graphics engine" for controlling three memory planes 47, 49, and 51, each of which is provided by a RAM memory in this example. The three memory planes 47, 49, and 51, are connected to the GDC 45 via data bus 53, and address bus 55. The three memory planes 47, 49, and 51 are scanned synchronously by the GDC 45, for reading out image data from the memories one word at a time, and parallel loading each word into shift registers 57, 59, and 61, associated with the memories 47, 49, 51, respectively. The data is then serially shifted out one pixel at a time from shift registers 57, 59, 61 to multiplexers 63, 65, and 67, respectively. The multiplexers 63, 65, 67 are controlled by the microprocessor 43 for either permitting the microprocessor 43 access to the color/image plane priority look-up table 69, 71, 73 (for setting up the color look-up table segments 69, 71, 73 to prioritize and select a color for each one of the image planes associated with memory planes 47, 49 and 51), or for permitting multiplexer 63, 65, 67 to couple pixel data to the color look-up table segments 69, 71, 73, from memory planes 47, 49, 51, respectively. In normal operation, the multiplexers 63, 65, 67 are operated for coupling pixel data to the look-up table segments 69, 71, and 73. High speed RAM memories, for example, can be used to provide the look-up table segments 69, 71, 73. When it is necessary to modify the look-up table, the multiplexers 63, 65, 67 are operated by the microprocessor for permitting the microprocessor access to the look-up table segments 69, 71, 73, respectively, to make whatever changes in the table are necessary.

In the normal mode of operation, the pixel data from the memory planes 47, 49, 51 are prioritized for establishing the image plane priority (and as a result color priority), in this example, via the look-up table segments 69, 71, and 73, respectively. The color prioritized pixel data is outputted from the look-up table segments 69, 71, 73 to video digital-to-analog converters (D/A's) 75, 77, 79, respectively. The D/A converters 75, 77, 79 convert the color prioritized digitally encoded pixel data to analog signals which are coupled to the green, red, and blue input terminals, respectively, of the video display 5. In this example, the color look-up table segments 69, 71, 73 are arranged for providing a green grid 81, a yellow curve or frequency spectrum 83 (in this example the pixel data for the frequency-spectrum curve 83 is applied to both the green and red input terminals of the video display 1), the vertical cursor lines 85 and horizontal lines 87 are red, and the background 89 is blue, as shown. The microprocessor 43 is programmed for permitting an operator to selectively change the colors of each one of the available image planes. In this example, only three image planes and a background are shown, for purposes of explanation, but the system can be expanded by adding additional memory planes, shift registers, multiplexers, color look-up table segments, and digital-to-analog converters for providing additional image planes, each of a particular selected color, up to a practical limit.

Figure 6:
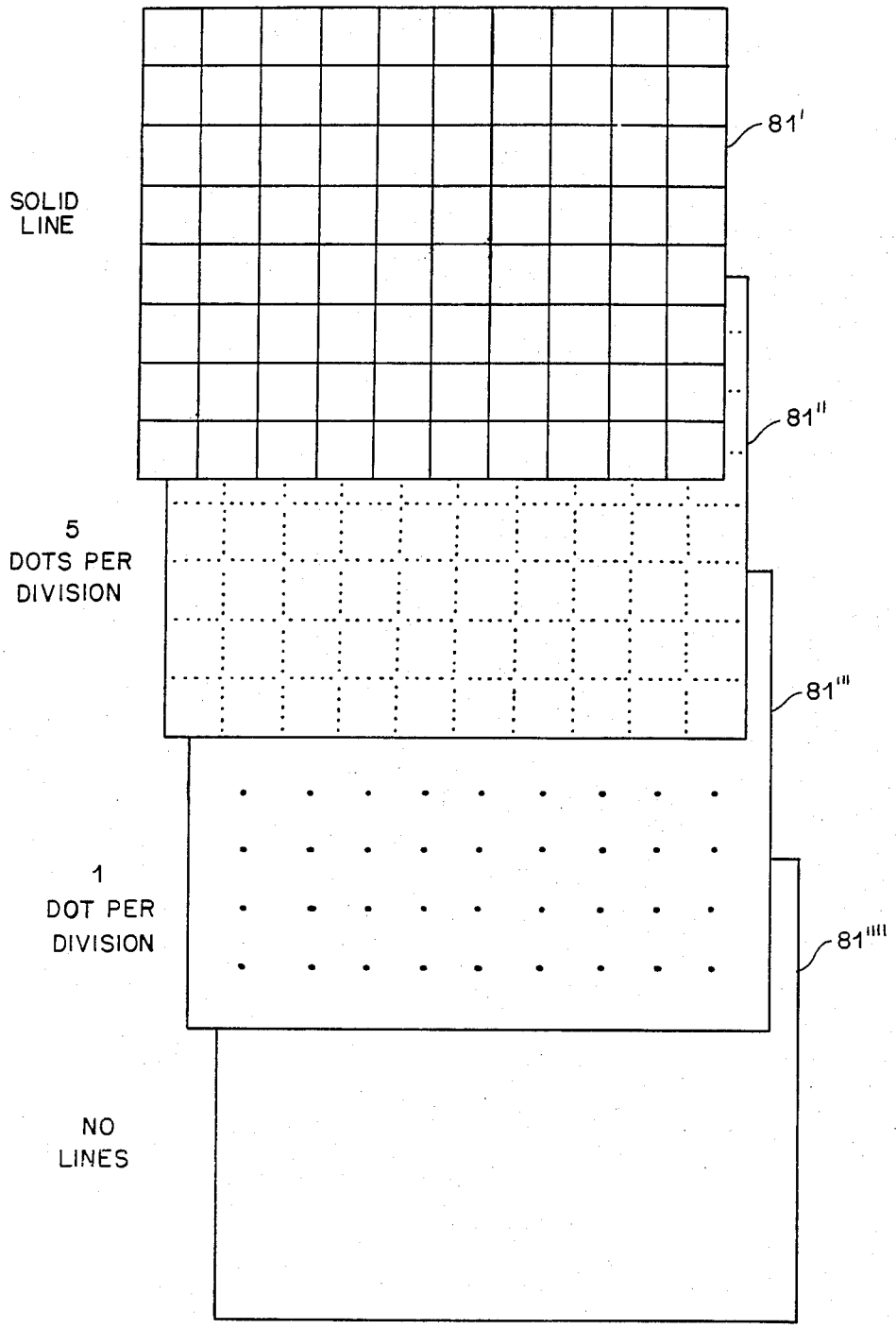
FIG. 6 is a pictorial presentation of a plurality of measurement grids selectively obtainable in another embodiment of the invention.

The microprocessor 43 is programmed to permit an operator to control the GDC 45 for selecting any one of a plurality of available measurement grids 81. For example, the GDC 45 is operable for selecting the grid examples shown in FIG. 6, such as a solid-line grid 81', a grid 81'' with five dots per division for the grid lines, and a grid 81''' having one dot per division for the grid lines. Alternatively, zero dots can be selected for eliminating the grid as in 81''''. Note that the present invention, in this example, is using an $8\times10$ division grid for permitting the measurement of a signal displaying a waveform for a frequency spectrum, to determine the various parameters of the waveform. In typical prior systems, the intensity of the grid lines is manually controlled for lowering the intensity when the signal waveform overlaps the grid line causing interference between the two. In high resolution color CRT display systems, typically having a resolution of $1024\times512$ pixels, it is extremely difficult to control the grid line intensity in an effective way to prevent interference between the grid lines and an overlapping waveform being displayed. By the present invention for establishing color priority amongst image planes assigned different colors, by assigning the image plane for the grid 81 the lowest priority, the lines of the grid 81 will always be hidden behind the displayed waveform for the signal being measured, thereby avoiding color mixing and other interference at points of overlap between the lines of the grid and the waveform for the signal. Alternatively, if desired, the grid 81 can be assigned some other priority, such as the highest display priority for overlaying without interference all other images being displayed of a lower priority. The grid intensity can be effectively controlled by changing the grid lines from solid lines, to dash lines, to dotted lines, as shown in FIG. 6.

Figure 7:
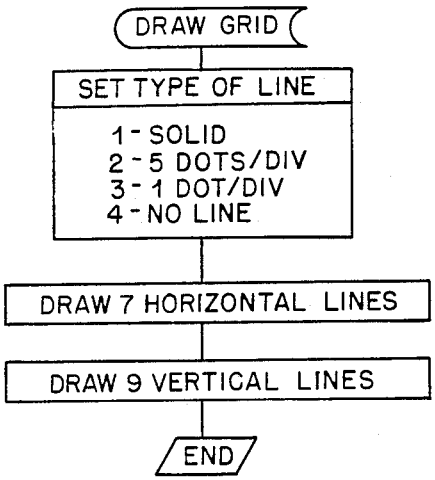
FIG. 7 shows a flow chart for the sequence of commands necessary for generating a selected grid on one of the image planes of a display system in one embodiment of the invention.

The multicolor display of the present invention uses bit mapped graphical techniques to generate images for display on the video display 5, such as a CRT (cathode ray tube). In this example, assume that the display screen 5 consists of 1024 by 512 dots, with each dot corresponding to a bit stored in a digital memory (and representing a pixel). The GDC 45 is used to control and generate bit patterns in the memories 47, 49, and 51 providing pixel data for the image planes of the present invention, as previously described. The microprocessor 43 controls the operation of the GDC 45 for generating the bit patterns. In FIG. 7, a flow chart showing the sequence of commands necessary for causing the GDC 45 to generate bit patterns for a desired grid is shown. As indicated, the microprocessor 43 first commands the GDC 45 to "draw a grid". The next required command is to "set the type of line" desired by designating the particular grid-type number, "1" through "4", for setting either a solid, five dots per division, one dot per division, or no grid lines, respectively. This is followed by a command to "draw 7 horizontal lines", followed by a final command to "draw nine vertical lines", thereby establishing in the memory or image plane 51, in this example, the bit patterns for the eight by ten grid that is desired.

Figure 8:
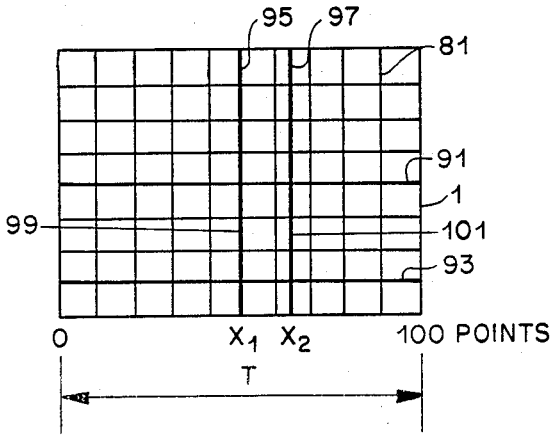
FIG. 8 is a pictorial example of dual cursors that are selectively generated in another embodiment of the invention for facilitating measurement of images being displayed.

Since it is difficult to accurately measure the difference between two points on a waveform through use of the grid lines 81 alone, measurement accuracy is greatly enhanced through the use of horizontal and/or vertical cursor lines positioned at the points that are to be measured or measured between, and by programming the microprocessor 43 to calculate the difference between the cursor lines for obtaining the desired measurement. By providing movable grid lines 81 via appropriate programming of the microprocessor 43 to control the GDC 45, the desired cursor lines can be obtained. In order to prevent confusion between the standard grid lines 81, and the cursor lines, different colors are assigned to the cursor lines and grid lines 81, in addition to making the image plane for the cursor lines have a higher priority than the image plane for the grid lines 81. Accordingly, wherever the cursor lines overlap a grid line 81, the cursor lines are not covered by the grid lines 81. In FIG. 8, a grid 81 is shown on a video display 5, having overlaying horizontal cursor lines 91, 93, and vertical cursor lines 95 and 97. These cursors 91,93 and 95, 7 can be selectively displayed at the same or at different times on video display 5. A waveform having two spike-like portions 99 and 101 is also shown. A cursor line, such as cursor lines 91, 93, 95, 97 can be placed anywhere within the area of the grid 81. In order to generate or reposition one of these cursor lines, it is necessary to first erase an "old" cursor line, and then "redraw it" at a new position. For example, assume that the difference to be measured (see FIG. 8) is from position $X_1$ to $X_2$, and that the total grid length T is divided into 100 segments of equal length, whereby the difference between points $X_1$ and $X_2$ is calculated as shown in equation (1) below:

$$\text{Difference} = T\,(X_1 - X_2)/100 \qquad (1)$$

A typical example is with T equal to 10 MHz, $X_1$ equal to 5.0 MHz, $X_2$ equal to 6.5 MHz, whereby the "difference" between these two points using equation (1) will be calculated by the microprocessor 43 to be 1.5 MHz, which result could be shown on the video display 5, or printed out on a printer, for example. If desired, the microprocessor 43 can be programmed to operate the GDC 45 for producing only one cursor line, or a desired number of cursor lines in either the vertical or horizontal axis.

Figure 9:
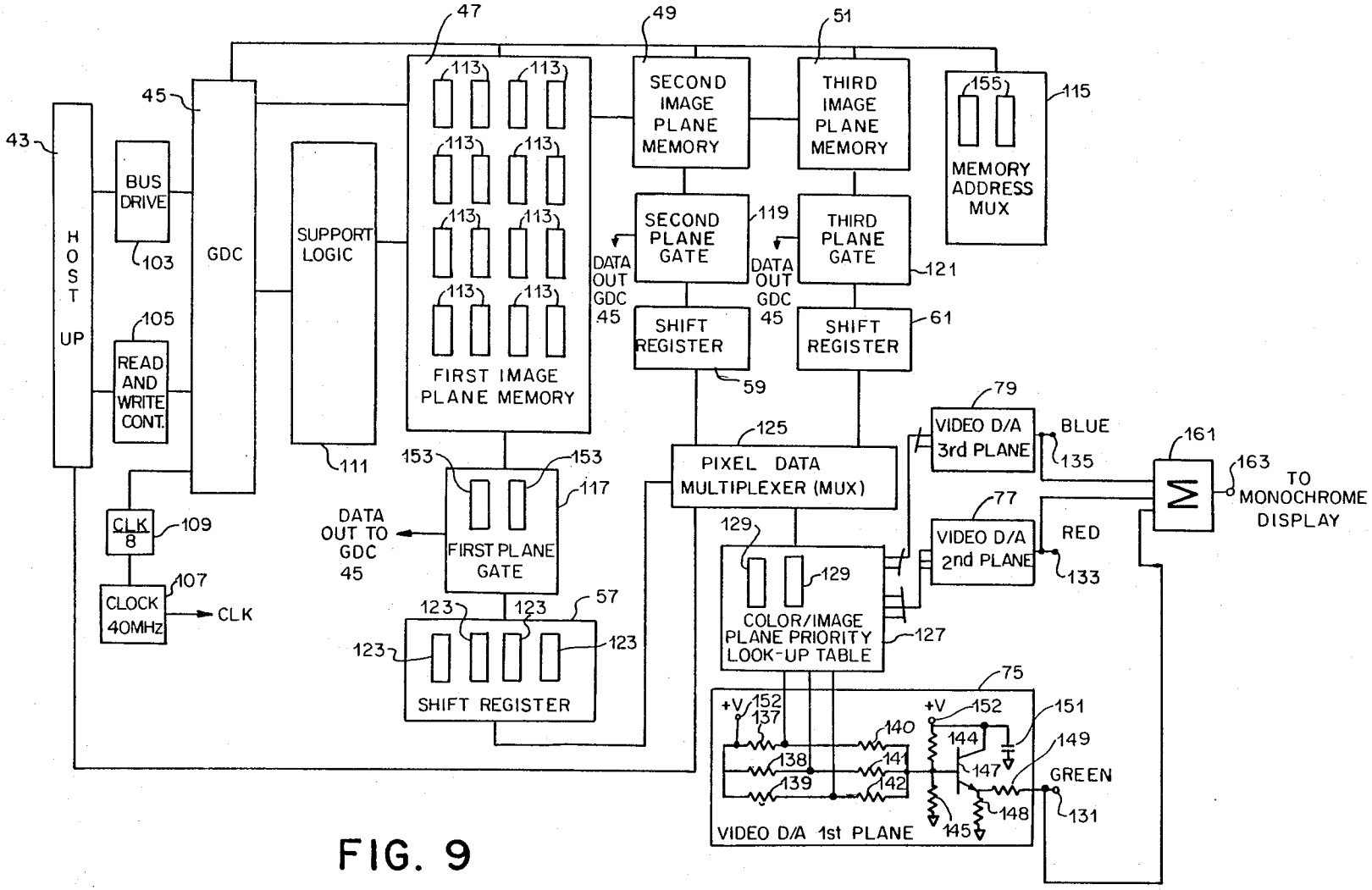
FIG. 9 shows a detailed block schematic diagram of an embodiment of the present invention.

In FIG. 9, a more detailed block-schematic diagram of an embodiment of the invention of FIG. 5 as shown. Note that the microprocessor 43 is labeled as a "HOST", and could be other than a microprocessor. For example, a minicomputer or computer, can be substituted for the microprocessor controller 43. A more detailed discussion of the operation of the embodiment of the present invention of FIG. 9 will now be given.

The GDC or graphics display controller 45, as previously mentioned, is operable for receiving drawing commands from a host CPU or microprocessor 43, which commands the GDC 45 processes to calculate or assemble pixel data for drawing a line segment or a curve, whereby the generated pixel data is written into a memory device, for example. GDC 45 also controls the dynamic memory refresh requirements of the system, while simultaneously providing data scanning functions to operate the memories 47, 49, and 51 for outputting pixel data to a raster scan CRT display, for example, such as video display 5. A bidirectional bus driver 103 is included for transferring data from the microprocessor 43 to the GDC 45. In this example, all drawing commands are passed one bit at a time from the microprocessor 43 to the GDC 45. When the microprocessor 43 is programmed for requesting data, data will flow from the GDC 45 to the microprocessor 43 via the bus driver 103. A read/write controller 105 provides the read/write control signal to the GDC 45 in response to commands from the microprocessor 43. Note that a very detailed description of the operation of a PD 7220/GDC graphics display controller is given in the data sheet for the previously-mentioned NEC PD7220/GDC used by the inventor in a prototype system. As indicated in the PD 7220 data sheet, there are 20 types of commands that the GDC 45 is responsive to. These commands are as follows:

| | |
|---|---|
| *Video Control Commands | |
| 1. RESET | Reset GDC to an idle state |
| 2. SYNC | Specifies the video display format |
| 3. VSYNC | Selects master or slave video synchronization mode |
| 4. CCHAR | Specifies the cursor and character row heights |
| *Display Control Commands | |
| 5. START | End idle mode and unblanks the display |
| 6. BCTRL | Control the blanking and unblanking of the display |
| 7. ZOOM | Specifies zoom factors for the display and graphics characters writing |
| 8. CURS | Set the position of the cursor in display memory |
| 9. PRAM | Defines starting addresses and lengths of the display areas and specifies the eight bytes for the graphics character |
| 10. PITCH | Specifies the width of the X dimension of display memory |
| *Drawing Control Commands | |
| 11. WDAT | Writes data words or bytes into display memory |
| 12. MASK | Sets the mask register contents |
| 13. FIGS | Specifies the parameters for the drawing controller |
| 14. FIGD | Draws the figure as specified |
| 15. GCHAR | Draws the graphics character into display memory |
| *Data Read Commands | |
| 16. RDAT | Reads data words or bytes from display memory |
| 17. CURD | Reads the cursor position |
| 18. LPRD | Reads the light pen address |
| *DMA Control Commands (Direct Memory Access) | |
| 19. DMAR | Requests a DMA read transfer |
| 20. DMAW | Requests a DMW write transfer |

The GDC 45 used in this example, namely a PD7220/GDC, uses single quadrant cartesian coordinates for organizing pixel data for storage in memory represented by 1024 rows, with each row including 64 words of memory for representing individual horizontal lines on the video display 5, respectively. Each word is 16 bytes long, thereby providing a total of 1024 discrete points along the x axis, with a maximum of 1024 lines. The origin of the video display 5, as mapped by the GDC 45, is located at the upper left-hand corner of display 5, and corresponds to a memory address "zero bit zero", with the display having addresses for the upper right-hand corner in memory of 63 bit 15, the lower left-hand corner a memory address of $1023 \times 64$ bit 0, and a lower right-hand corner memory address of $1023 \times 64 + 63$ bit 15. The prototype system of the present invention developed by the inventor included 1024 points on the x axis, and only 512 points on the y axis. Accordingly, in the prototype system, to draw a line from the upper left-hand corner to the lower right-hand corner of the video display 5, the coordinates of the lower right-hand corner are (1023, 511), which coordinates have a memory address of 32767 [(512](64)−1], and the bit number within that word is the remainder of 32767 divided by 16, which equals 15. After the coordinates of a particular line segment have been determined, it is required that a line command be sent with parameters derived from the previously-mentioned coordinates to the GDC 45, whereby a line segment will be drawn in the memory, and transferred therefrom for presentation on the video display 5, as previously explained in broad terms, and as will be explained below in greater detail.

In the prototype system, a 40 MHz clock 107 is used to provide the system timing. The clock 107 is a crystal oscillator for ensuring accuracy, and all clock signals are derived from the 40 MHz clock output of clock 107. The clock signal is divided by eight via the divider 109 to provide a 5 MHz clock signal to the GDC 45 support logic 111 included for generating the necessary timing signals for controlling the memory planes 47, 49, and 51, and the flow of data to other of the circuitry or logic. The requirements for such support logic 111 are considered standard logic network means, and are not described in detail here for the sake of simplicity, but details of certain of the support logic requirements are given in the PD7220 data sheets, and the data sheets for the other logic forming the system of FIG. 9. Part numbers for the major logic used in the prototype system for the subject invention are given below.

The first, and third image plane memories 47, 49, and 51 each consist of sixteen integrated circuits 113 as illustrated in the first image plane memory 47. Each one of the integrated circuits 113 is a 64K RAM memory. Accordingly, each one of the memory planes 47, 49, 51 includes 64K×16 bytes of memory, and between these three memories 48 RAM memory integrated circuits 113 are used. The memories 47, 49, 51 are organized to output one word at a time, whereby each word corresponds to 16 contiguous dots on the video display 1, with each dot representing a logical result of the data of the three memory planes 47, 49, 51 having the same address. The GDC 45 includes 16 address lines for addressing the memories 47, 49, 51, and two additional address lines for distinguishing between the different first, second, and third image planes (that is between the individual memories 47, 49, 51).

The memory address lines from the GDC 45 are processed through a memory address multiplexer 115 for forming a multiplexed 8-byte address line (8 address lines are switched between 16 address lines from the GDC 45 for providing dynamic memory). In this example, 16 data lines are connected between the GDC 45 and the memories 47, 49, 51, for inputting data to the memories 47, 49, 51. Further in this example, each of the memories 47, 49, 51 includes 16 data output lines connected via first, second, and third plane gate networks 117, 119, 121, respectively, to the shift registers 57, 59, 61, respectively, and to the GDC 45. GDC 45 receives the data output from the gates 117, 119, 121 for processing data from the first through third image plane memories 47, 49, 51, respectively. In this manner, GDC 45 accesses the image plane data stored in memories 47, 49 and 51.

As illustrated for shift register network 57, each of the shift registers 57, 59, 61 includes four integrated circuit shift registers 123, respectively. As previously mentioned, the GDC 45 operates to scan the memories 47, 49, 51 (the RAM chips 113 thereof) sequentially one word at a time for providing sixteen bytes of pixel data to the four shift registers 123 of each one of the shift register networks 57, 59, 61, respectively. The shift register networks 57, 59, 61 provide two functions, one being to convert the parallel received sixteen bytes of pixel data from memory to a serial format for ultimate use after conversion to analog form by the video display 5, with the other function being to reduce the speed requirements of GDC 45 by factor of sixteen.

As indicated, the pixel data are outputted from the shift registers 57, 59, 61 in serial format, whereby only a single line from each one of the shift registers 57, 59, 61 is connected to the pixel data multiplexer (MUX) 125 (includes multiplexer segments 63, 65, and 67 shown in FIG. 5), before the data is transferred to the color/image plane priority look-up table 127 (includes look-up table segments 69, 71, and 73 of FIG. 5), as shown. Multiplexer 125, as previously explained, provides access to the RAM memories 129 of look-up table 127 for either the microprocessor, or the pixel data derived from the first, second, and third image plane memories 47, 49, 51, via gates 117, 119, 121 and shift register networks 57, 59, 61, respectively. The microprocessor 43 is coupled to the look-up table 127 whenever the colors designated for each one of the memory planes 47, 49, 51 and/or their relative color priority must be changed. In the prototype system for the present invention, three lines are connected from the multiplexer 105 to the look-up table RAM memories 129 for selecting one out of eight RAM memory 129 locations. Note that when the multiplexer 125 is operated to connect the microprocessor 43 to the look-up table 127, the microprocessor or host computer 43 can be utilized to also provide desired pixel data or graphical information to the color look-up table 127, in addition to changing designated colors or color priorities for the image planes. In this manner, images other than those stored in memories 47, 49, and 51 can be displayed.

In FIG. 10, a table is shown for providing a simple example of the arrangement of the color look-up table 127, in one application. The first column of the table shows the image to be displayed, that is, the grid, cursor lines, curve under examination and background. The next three columns show the digital coding for the bytes of pixel data from the first, second, and third image planes ("off" is equivalent to a digital "zero", and "on" is equivalent to a digital "1"Z, and "X" indicates that the digital state of the particular pixel data byte is not significant. The fifth through sixth columns of the table indicate the data byte condition at the green, red, and blue input terminals, respectively, of the color display 5. The last column indicates the resultant color of the particular image being displayed as a result of the coding used. In this illustrative case, the background on the video display 1 will be blue, the waveform or curve will have a yellow color, the cursor lines will be red, and the grid lines will be green. The first image plane memory 47 providing pixel data for the waveform or curve (a frequency spectrum waveform, for example) will have a first priority, and as a result the waveform 83 will overlay all other images for image planes presented on the video display 5 (wherever curve 83 intersects any other image, the curve 83 takes priority). Second priority is assigned to the cursor lines 91, 93, 95, 97 and they will take priority at any intersection point of images over all images other than the waveform 83. Third priority is assigned to the grid lines 81 or grid image plane (the third image plane), and the background image plane is of the lowest priority. Although the look-up table 127 arrangement shown in FIG. 10 indicates the coding for each color as being designated by only a single byte, in this example, each of the colors can have two or three bytes of data for designating when that color input terminal is activated by pixel data, and providing intensity control for each color. In the prototype system, the latter situation exists, whereby three data byte lines are provided from the color look-up table 127 to each one of the video D/A converters 75, 77, 79, respectively. As previously indicated, the D/A converters 75, 77, 79 convert the digital data to a voltage proportional in amplitude to that data. In this manner colors such as cyan, magenta, orange, grey, and so forth can be provided for different image planes that are to be displayed. Accordingly, the actual color look-up table 127, in binary form, may appear as shown in FIG. 11. As indicated, in this example there are three images planes designated by the numerals "1, 2, and 3", the primary colors green and red each have three data bytes associated with them, whereas the blue input color has two data bit lines associated with it. As shown from table locations 2, 4, 6, and 8, image plane 1 has the highest priority, whereby image data in that image plane will be presented on the video display 1 overlayed over all other image data or image planes (wherever pixel data from other image planes intersect with pixel data for image plane 1, the pixel data for image plane 1 takes priority). The pixel data in image plane 2 has second priority, in image plane 3 third priority, and when pixel data from the three image planes is not present, the least priority background image is presented for providing a blue background, in this example. As previously indicated, the table setup shown in FIG. 11 can be selectively changed for altering the colors designated for each one of the three image planes of this example.

With further reference to FIG. 9, in the prototype spectrum analyzer system incorporating the multicolor display of the present invention, the video D/A's 75 and 77 for the first and second image planes, respectively, are connected to the Green and Red input terminals 131 and 133, respectively, of the video display 5. The video D/A 79 for the third image plane receives two data byte lines from the color look-up table 127, and has an output signal lead connected to the Blue input terminal 135 of the video display 5. These connections correspond to the arrangement of the color look-up table shown in FIG. 11.

Note that the video D/A 77 and 79 each have a design as indicated in the video D/A 75 for the first image plane. As shown, the digital-to-analog converter circuit thereof includes voltage scaling resistors 137 through 145, an NPN transistor 147, an emitter resistor 148, an output coupling resistor 149, a filter capacitor 151, and power terminals 152 for connection to a DC source of +V volts. The values of the resistors 137 through 145 are adjusted for permitting the level of the output voltage from the D/A's 75, 77, 79, to be adjusted for giving different intensities for each color on the video display 5. For example, if the data byte lines from color look-up table 127 to the video D/A for the first image plane 75 are each at digital 1, the output voltage level from the D/A 75 will be at a maximum for providing the greatest intensity green for the image data in the first input image plane being displayed, whereas other digital representations for the data byte lines to the D/A 75 would provide lower level output signals to the green input terminal 131 of video display 5, resulting in lower intensity green for the image data of the first image plane. A similar result is obtained for the video D/A 77 for the second image plane, in this example having an output connected to the red input terminal 133 of the video display 1. The video D/A 79 for the third image plane is identical to the circuit shown in the video D/A 75, except that only two data byte lines are connected to the circuit, whereby two of the series connected scaling resistors (137 and 140, or 138 and 141, or 139 and 142) can be eliminated, if desired, in this example.

Note that the gates 117, 119, and 121, in this example as shown for gate 117, each include two integrated circuit gates 153. Also, the memory address MUX 115 includes two integrated circuit chips 155.

In the prototype system incorporating the present invention, as previously mentioned, the GDC 45 is provided by an NEC PD7220/GDC. Also, the RAM memories 113 for the first through third image plane memories 47, 49, and 51 are integrated circuit 4164 RAMS; the memory address MUX 115 includes integrated circuit 74257's for the two integrated circuit chips 155; the pixel data multiplexer 125 is provided by an integrated circuit 74257; the shift register integrated circuits 123 for the shift register networks 57, 59, and 61 are provided by integrated circuit 74F194 shift register chips; integrated circuit 4164 chips provide the gates 153 for the first through third plane gates 117, 119, 121, respectively; the integrated circuit chips 129 are provided by 74F189 RAM chips for the color look-up table 127; the bus drive 103 is provided by a 74LS245 integrated circuit; and the read/write controller 105 is provided by a 74LS32 integrated circuit chip. Other types of digital logic integrated circuit chips may also be used for providing the various functions of the logic and analog circuitry of the present invention.

The various embodiments of the present invention are also applicable for use with monochrome display systems, where a plurality of images are to be superimposed for display on a display device. With further reference to FIG. 9, by combining the output pixel data from the video D/A's 75, 77, 79, for the first through third memory planes 47, 49, 51 respectively, via summer 161, a single output line is provided from output terminal 163 for connection to a monochrome display. Only the pixel data from the highest priority image plane will be provided at the output terminal 163 at any given time. Also, the intensity of the various images to be superimposed on the monochrome display is controlled via the three byte data lines from the color/image plane priority look-up table 127 to the video D/A's 75, 77, 79, respectively. Through appropriate coding, the intensity of the various images for monochrome superposition display is controllable for avoiding hidden lines. The intensity control was previously described relative to the application of the invention in a multi-color display system.

Although particular embodiments of the present invention have been shown for purposes of illustration for use in a spectrum analyzer, such an illustration is not meant to be limiting, in that the various embodiments of the inventions have many other applications as covered by the scope and spirit of the appended claims.

What is claimed is:

1. A display system for displaying a plurality of superimposed images on a display device, said system comprising:

first means for generating patterns of pixel data bits for at least one image for display in a first image plane;

second means for generating patterns of pixel data bits for displaying a measurement grid in a second image plane, for permitting measurement of various parameters of said one image to be made;

said second generating means further including means for selecting pixel data for a measurement grid having either solid lines, or selectively dense dashed lines, or selectively dense dotted lines, for thereby effectively controlling the intensity of said measurement grid relative to said other of the images being displayed on said display device;

third means for selectively generating patterns of pixel data bits for displaying one or more horizontal and/or vertical cursors in a third image plane, positioned on said display relative to said measurement grid and said one image, for facilitating the taking of said measurements;

fourth means for selectively generating a data signal for displaying a background image;

prioritizing means for receiving the pixel data bits from said first, second, third, and fourth generating means for selectively establishing a priority hierarchy for said first, second, and third image planes, the individual pixel data bits of a given image plane all having the same priority as their associated one of said first through third image planes, whereby at points of intersection on said display of pixel data for either any two or more of said one image, measurement grid, horizontal and/or vertical cursors, and background, only the pixel data bits for the highest priority image plane is provided to said display device for display at the point of intersection, and for providing said data signal, if present, in the absence of pixel data bits for said first through third image planes for displaying a background image; and means for coupling said prioritized pixel data bits from said prioritizing means to said display device.

2. The display system of claim 1, further including:

processing means responsive to the positioning of said horizontal and vertical cursors relative to said one image, for automatically calculating the desired measurement(s).

3. The display system of claim 1, wherein said coupling means includes:

first through third digital-to-analog converter (D/A) means for receiving and converting from digital to analog signals the pixel data bits from said prioritizing means for said first through third image planes, respectively, for connection to said display device.

4. The display system of claim 3, wherein said first through third D/A converter means each further include means for selectively controlling the amplitude of the associated analog output signal, thereby providing intensity control of the related image on said display device.

5. The display system of claim 4, wherein said display device is a color display having red (R), green (G), and blue (B) input terminals (RGB), and said first through third D/A means each have an output line coupled to said RGB terminals, respectively, the images in each of said first through third image planes having a selected color determined by which one(s) of the RGB input terminals to which the pixel data bits for a given image plane is connected.

6. The display system of claim 4, wherein said display device is a monochrome display having a single input terminal, and wherein said first through third DAC means each have an output line connected to an individual input terminal of a summing circuit, an output terminal of said summing circuit being connected to the input terminal of said display device.

7. The display system of claim 1, wherein said prioritizing means includes look-up table means selectively arranged for comparing the pixel data bits for each one of said image planes, for establishing the priority hierarchy for each of said first, second, and third image planes, whereby for each pixel location on said display device, said look-up table provides pixel data bits only for the highest priority image plane having pixel data bits for display at said pixel location.

8. The display system of claim 1, wherein said display device consists of a color display device having at least RGB input terminals, and wherein said prioritizing means includes:

a first output terminal for receiving pixel data bits for the highest priority image plane, for connection to the appropriate one(s) of said RGB input terminals for displaying the related image in a desired color;

first through third inverter means, each having an input terminal for receiving pixel data for one of the second, third, and fourth highest priority image planes, respectively, and an output terminal for providing the inverted pixel data for said second, third, and fourth highest priority image planes, respectively;

first through third AND gates each associated with one of said second, third, and fourth highest priority image planes respectively, each having a first input terminal for individually receiving pixel data for their associated image plane, respectively, each having a second input terminal connected in common to the output terminal of said first inverter means, said second and third AND gates each having a third input terminal connected in common to the output terminal of said second inverter means, said third AND gate having a fourth input terminal connected to the output terminal of said third inverter means, whereby said first AND gate provides as an output signal the pixel data for the second highest priority image plane whenever no pixel data is present for said first image plane, said second AND gate provides as an output signal the pixel data for the third highest priority image plane, whenever no pixel data is present for either of the first and second highest priority image planes, and said third AND gate provides as an output signal the pixel data for a background image, whenever pixel data is not present for the first through third highest priority image planes.

9. In a display system for displaying on a display device a plurality of superimposed images, the method comprising the steps of:

selectively generating patterns of pixel data bits for (1) at least one image for display in a first image plane, (2) a measurement grid for display in a second image plane, for permitting measurement of various parameters of said one image to be made, and (3) horizontal and vertical cursors for display at the same or different times in a third image plane;

varying the line consistency or continuity of said measurement grid, for controlling the intensity level of said measurement grid in said second image plane relative to the images in said first and third image planes;

storing in memory means the pixel data bits for said one image, measurement grid, and horizontal and vertical cursors;

transferring the pixel data bits from said memory means to a prioritizing means for establishing a priority hierarchy for each pattern of pixel data bits of said first, and second and third image planes, respectively, whereby only the pixel data bits associated with the one of said image planes of highest priority will be displayed at points on said display device where the pixel data bits for more than one of said image planes intersect; and coupling said pixel data to said display device.

10. A system for substantially eliminating undesirable color mixing at positions on a multicolor display, where two or more images of different colors intersect, comprising:

means for establishing a plurality of image planes, each for a different colored image;

prioritizing means for establishing both a color and a priority hierarchy for said plurality of image planes;

means for displaying on said multicolor display only pixel data bits for the highest priority image plane in the selected color at points where the pixel data for more than one image plane intersect;

said means for establishing a plurality of image planes further including means for generating pixel patterns for providing a measurement grid in one image plane; and said grid generating means further including means for selectively providing either solid, dashed, or dotted lines for said grid for controlling the intensity thereof relative to images displayed from other image planes.

11. The system of claim 10, wherein said means for establishing a plurality of image planes further includes means for generating pixel patterns for providing horizontal and vertical cursors in one image plane for placement at measurement points on a superimposed image displayed in another image plane.

12. The system of claim 11, further including:

processing means responsive to the location of said horizontal and vertical cursors, for automatically calculating the particular measurement being made relative to said superimposed image.

13. In a display system for displaying a plurality of images in superposition on a display device, a logic circuit for establishing prioritized image planes for pixel data bit patterns associated with each image plane to eliminate interference between intersecting ones of said superimposed images, comprising:

a look-up table including a plurality of n pixel data input terminals for receiving data input bits for pixel data bit patterns associated with n prioritized image planes, respectively, where n is an integer number 1, 2, 3, . . . , and n also represents both the priority and number of a particular image plane, the lower the number the higher the priority, the pixel data bit patterns having the same priority as their associated image plane;

first coupling means for connecting pixel data from a first one of said plurality of image planes (n=1) directly to a first one of said plurality of pixel data input terminals, thereby establishing the highest priority image plane;

a plurality of (n−1) AND gates, each associated with second through $n^{th}$ Priority image planes, respectively, each having a plurality of input terminals equal in number to the number of their associated image plane, with one of said input terminals being for receiving the pixel data bits for the image for an associated one of said n image planes, and the other ones of said plurality of input terminals of each one of said AND gates being for receiving inverted pixel data bits for the preceding higher priority ones of said n image planes, respectively, and each one of said AND gates having an output terminal for providing pixel data bits for the associated prioritized one of said second through $n^{th}$ image planes, respectively, for connection to the second through $n^{th}$ ones of said n pixel data input terminals, respectively;

a plurality of (n-1) inverters each associated with a particular one of said second through (n-1) image planes, respectively, each having an input terminal for receiving the pixel data bits for the preceding higher priority image plane and each having an output terminal for coupling inverted pixel data bits for the associated preceding higher priority image plane in common to the input terminals of said AND gate for the associated image plane and the AND gates associated with all lower priority third through $n^{th}$ image planes, respectively; and said lookup table further including a plurality of output terminals for connection to a plurality of input terminals, respectively, of said display device, said look-up table being arranged for selectively connecting the pixel data bits for each prioritized image plane to either a given one or combination of said plurality of its output terminals, for display on said display device.

14. The display system of claim 13 wherein said display device is a color display device having red, green, and blue input terminals for said plurality of input terminals, respectively, said lookup table being arranged for displaying each one of said prioritized image planes in a selected color, respectively.

15. In a display system for displaying a plurality of superimposed images, said system comprising:

means for selectively generating and displaying either one or both of a pair of horizontal cursors and a pair of vertical cursors, positioned for display relative to an image for facilitating the taking of measurement of various parameters of the image; and means for measuring the spacing between the cursors of a pair of cursors being displayed for determining one or more desired measurements.

16. The display system of claim 15, wherein said cursor generating means further includes means for separately and individually positioning each cursor of the ones of said pairs of horizontal and vertical cursors being displayed.

17. In a display system for a spectrum analyzer or the like, the method comprising creating a first bit pattern of pixel data bits representing a measurement grid;

creating a second bit pattern of pixel data bits representing a pair of parallel cursors;

creating a third bit pattern of pixel data bits representing a signal to be displayed;

each pixel corresponding to an elemental area at a respective location on said display;

causing the data bits of each of said bit patterns to produce a display of a single respective color in a respective display pattern corresponding to said grid, said cursors, and said signal;

causing each display-producing pixel data bit of said third bit pattern to inhibit display of color by pixel data bits of said first and second bit patterns which are at the same location as the respective pixel data bit of said third bit pattern;

varying said second bit pattern to represent different positions of the images of said cursors relative to one another while maintaining said inhibiting of said second pattern pixel data bits; and further including measuring a characteristic of said displayed signal by adjusting the separation of the images of said cursors to encompass a characteristic-indicating section of the display of said signal.

18. In a display system for a spectrum analyzer or the like, the method comprising creating a first bit pattern of pixel data bits representing a measurement grid;

creating a second bit pattern of pixel data bits representing a pair of parallel cursors;

creating a third bit pattern of pixel data bits representing a signal to be displayed;

each pixel corresponding to an elemental area at a respective location on said display;

causing the data bits of each of said bit patterns to produce a display of a single respective color in a respective display pattern corresponding to said grid, said cursors, and said signal;

causing each display-producing pixel data bit of said third bit pattern to inhibit display of color by pixel data bits of said first and second bit patterns which are at the same location as the respective pixel data bit of said third bit pattern;

said second bit pattern representing cursors including a pair of horizontal cursors and a pair of vertical cursors; and selecting one or the other or both of said two pairs of cursors for display.

* * * * *

UNITED STATES PATENT AND TRADEMARK OFFICE

CERTIFICATE OF CORRECTION

PATENT NO. : 4,868,552

DATED : September 19, 1989

INVENTOR(S) : Tsong-Ju P. Chang

It is certified that error appears in the above-identified patent and that said Letters Patent is hereby corrected as shown below:

In column 4, line 25, after "AND", change --"gages"-- to --"gates"--.

In column 6, line 2, after "nth", insert a period after "memory" and in line 3, delete --"convenience for convenience"--.

In column 7, line 52, after "display", change --"1"-- to --"5"--.

In column 9, line 9, after "95", change --"7"-- to --"97"--.

In column 12, line 40, after "1", delete --"Z"--.

Signed and Sealed this

Fourth Day of September, 1990

*Attest:*

HARRY F. MANBECK, JR.

*Attesting Officer*

*Commissioner of Patents and Trademarks*